US008430994B2

(12) United States Patent
Baker et al.

(10) Patent No.: US 8,430,994 B2
(45) Date of Patent: Apr. 30, 2013

(54) MAKING SHEETS

(75) Inventors: Malcolm Paul Baker, Hampshire (GB); Andrew Malcolm Macey, Hampshire (GB); Adrian Donald Ash, Hampshire (GB)

(73) Assignee: De La Rue International Limited, Basingstoke, Hampshire (GB)

( * ) Notice: Subject to any disclaimer, the term of this patent is extended or adjusted under 35 U.S.C. 154(b) by 6 days.

(21) Appl. No.: 12/933,630

(22) PCT Filed: Jan. 22, 2009

(86) PCT No.: PCT/GB2009/000176

§ 371 (c)(1),
(2), (4) Date: Nov. 4, 2010

(87) PCT Pub. No.: WO2009/115766

PCT Pub. Date: Sep. 24, 2009

(65) Prior Publication Data

US 2011/0042023 A1 Feb. 24, 2011

(30) Foreign Application Priority Data

Mar. 19, 2008 (GB) ..... 0805123.7

(51) Int. Cl.
*B42D 15/00* (2006.01)
*D21H 21/42* (2006.01)
*B41M 3/10* (2006.01)

(52) U.S. Cl.
USPC ..... 162/110; 162/140; 428/84; 428/169; 428/192; 428/212; 283/72; 283/113

(58) Field of Classification Search ..... 162/103, 162/110, 140, 201; 428/84, 169, 192, 212, 428/81, 156, 187; 283/72, 113
See application file for complete search history.

(56) References Cited

U.S. PATENT DOCUMENTS 225,279 A * 3/1880 Hayward ..... 283/70
964,014 A * 7/1910 Gernaert ..... 162/104

(Continued)

FOREIGN PATENT DOCUMENTS

EP 1466755 A2 10/2004
EP 1466756 A2 10/2004

(Continued)

OTHER PUBLICATIONS

James D'A. Clark, "Some Effects of Forces," Pulp Technology and Treatment of Paper, Miller Freeman Publications, Inc. (San Francisco, California), (p. 69-76), (Oct. 21, 1978).

*Primary Examiner* — Jose A Fortuna
(74) *Attorney, Agent, or Firm* — GableGotwals

(57) ABSTRACT

The invention is directed toward improvements in security substrates, such as paper, used for making security documents, such as bank notes, having anti-counterfeit able features and in particular to security substrates incorporating an elongate security element and methods of making the substrate. The invention comprises a security substrate for making security documents and the like comprising a fibrous base substrate and an elongate security element at least partially embedded therein. At one surface of the security substrate one portion of the security element is exposed to provide a continuous track along the length of the security element. A plurality of other portions along at least one edge of the security element are partially covered by overlapping regions of the fibrous substrate. The invention further comprises a method of manufacturing such a security substrate.

23 Claims, 8 Drawing Sheets

U.S. PATENT DOCUMENTS

| | | | | | |
|---|---|---|---|---|---|
| 4,552,617 | A | * | 11/1985 | Crane | 162/103 |
| 4,761,205 | A | * | 8/1988 | Crane | 162/103 |
| 4,943,093 | A | * | 7/1990 | Melling et al. | 283/83 |
| 5,265,856 | A | | 11/1993 | Walker | |
| 5,516,153 | A | * | 5/1996 | Kaule | 283/85 |
| 5,573,639 | A | * | 11/1996 | Schmitz et al. | 162/140 |
| 5,989,389 | A | * | 11/1999 | Sundberg | 162/109 |
| 6,402,888 | B1 | * | 6/2002 | Doublet et al. | 162/140 |
| 7,070,678 | B2 | * | 7/2006 | Allen et al. | 162/109 |
| 7,399,513 | B2 | * | 7/2008 | Pearson et al. | 428/84 |
| 7,704,585 | B2 | * | 4/2010 | Pearson et al. | 428/84 |
| 2005/0163970 | A1 | * | 7/2005 | Pearson | 428/152 |
| 2008/0238086 | A1 | * | 10/2008 | Geuens et al. | 283/110 |
| 2008/0305308 | A1 | * | 12/2008 | Pearson et al. | 428/192 |
| 2010/0071609 | A1 | * | 3/2010 | Rosset | 116/201 |
| 2011/0042023 | A1 | * | 2/2011 | Baker et al. | 162/110 |

FOREIGN PATENT DOCUMENTS

| | | | | |
|---|---|---|---|---|
| EP | 2028017 | A2 | * | 2/2009 |
| GB | 2381539 | A | * | 5/2003 |
| GB | 2458485 | A | * | 9/2009 |
| WO | WO 94/20679 | | | 9/1994 |
| WO | WO 03/046282 | A1 | | 6/2003 |

* cited by examiner

MAKING SHEETS

CROSS-REFERENCE TO PENDING APPLICATIONS

This application is the United States National Phase of PCT Patent Application No. GB2009/000837 filed on 27 Mar. 2009, which claims priority to British Patent Application No. 0805916.4 filed 1 Apr. 2008, both of which are incorporated herein by reference.

The following documents are incorporated herein by reference:

- GB 1552853, "Improvements In Or Relating To Authentication Devices" in the name of Peter Denis Lee;
- EP 0059056, "Sheet Materials, Methods For Making Sheet Materials and Security Documents" in the name of Portals Limited;
- WO 2000/39391, "Improvements in Making Paper" in the name of De La Rue International Limited;
- WO 2003/095188, "Improvements in Fibrous Sheets" in the name of De La Rue International Limited;
- WO 2004/001130, "Fibrous Substrates" in the name of De La Rue International Limited;
- WO 2005/106601, "Improved Optically Variable Devices" in the name of De La Rue International Limited;
- WO 2006/095161, "Security Device Based On Customized Microprism Film" in the name of De La Rue International Limited The invention relates to improvements in methods of making sheets for security documents having edge or corner reinforcing watermarks and a surface applied feature.

Folded or bent corners (corner folds or dog-ears) on banknotes present a significant problem for many banks, as they can cause problems in cash handling machines and can result in an artificially short note life. Many machines will reject such notes from circulation. One major European central bank has indicated that 80% of the rejections from their machines are due to such corner folds. Notes with folded corners can also be problematic in ATMs and cash dispensers and other note handling equipment. This is becoming a more significant problem as the use of such machines is becoming more and more widespread.

Efforts have been made to resolve this problem by providing note handling equipment with apparatus for flattening banknotes to enable a dog-eared or curled document to be fed without jamming. Such a system is described in U.S. Pat. No. 5,265,856.

Another problem, which occurs with banknotes in particular, results from the tendency of users to roll and fold notes for storage or keeping in wallets and purses. This gives rise to damage at the middle of the edges of the notes and similar problems arise in ATMs and other note handling equipment as occurs with dog-ears and corners.

Furthermore there is also a significant problem with edge tears in banknotes and the propagation of such edge tears.

The use of corner and edge reinforcing watermarks has been described in WO-A-03/046282, EP-A-1466755, and EP-A-1466756. The structures described in the prior art have been very successful in solving the aforementioned problems.

In addition to dealing with the aforementioned problems, bank notes and other security documents require security features that can be easily recognised and verified by the public without the need for additional verification devices. Security devices of the type described herein are intended for use on documents of value including, but not limited to, banknotes, fiscal cheques, travellers cheques, fiscal stamps, postal stamps, certificates of authenticity, brand protection articles, bonds, certificates, vouchers and the like.

It is widely accepted that, when producing security documents, a range of security features is required. This is both to overcome the efforts of counterfeiters and to enable inspection of the documents at a number of different levels. It is usually considered that the inspection of security documents falls into one of three categories; public, teller assist and covert.

Inspection of documents at a public level requires the feature to be overt, or not to require additional aids to verify. Examples of public security features include windowed and embedded threads, cylinder mold watermarks, holographic foils and stripes, intaglio print, colorshifting or optically variable inks, thermochromic features, embossed or printed latent features. All these features will be familiar to those skilled in the art and they are also widely discussed in many publications, including many published patent specifications. It is important to note that several of the above features are not apparent until viewed or handled in the correct manner, e.g. latent images. Such features, though not overt, can still be authenticated using the human senses and handling alone and do not require the use of a secondary device or piece of equipment.

The use of optically variable security features in the form of surface applied stripes and foils are very common on banknotes and other secure documents. The preferred method for transferring stripes or patches is known as the transfer method in which an optically variable device is formed on a carrier substrate and transferred to the security document in a subsequent working step. The optically variable device can be applied to the security document using an adhesive layer. The adhesive layer is applied either to the optically variable device or the surface of the secure document to which the optically variable device is to be applied. After transfer, the carrier substrate may be removed, leaving the optically variable device as the exposed layer.

Alternatively the carrier layer can remain as part of the structure acting as an outer protective layer.

Optically variable devices may take a variety of forms including holograms, diffraction gratings, micro-optical structures (such as those comprising microlenses and microprisms), angular dependent colored reflection generated from materials such as liquid crystal materials, thin film interference structures, multilayer polymeric structures and photonic crystal structures.

The application of a surface applied material to a sheet having corner or edge reinforcing watermarks has proved problematic due to the poor adhesion of the stripe or patch to the regions of variable profile resulting from the plurality of reinforcing bars forming the watermarks.

BRIEF SUMMARY OF THE INVENTION

It is therefore an object of the present invention to provide an improved method of making paper sheets for security documents which enables a surface applied security feature such as a stripe or patch to be used in conjunction with a corner or edge reinforcing watermark.

The invention therefore provides a method of making a sheet from a fibrous substrate, the sheet having corners and edges joined at the corners, comprising the step of forming the substrate by depositing fibers on a support surface, fanning at least one reinforcing watermark at a predetermined position in the substrate, which at least one reinforcing watermark increases the stiffness of the sheet in the watermarked region, the reinforcing watermark being a positive watermark formed by varying the grammage of fibers of the substrate to form at least two adjacent bars of increased grammage relative to the mean grammage of fibers in adjacent areas of the substrate, and further forming at least one raised region, formed by increasing the grammage of fibers, which at least one raised region joins the adjacent bars within the at least one reinforcing watermark to form a smooth planar surface, and applying a substantially planar security feature to a portion of at least one surface of the substrate across the smooth planar surface.

The substrate is preferably first formed as a web which is subsequently cut into a plurality of sheets or the substrate forms a single sheet.

The reinforcing watermarks are preferably formed in at least one corner of the sheet so as to increase the stiffness of the sheet in said corners and/or along at least one edge of the sheet so as to increase the stiffness of the sheet along said at least one edge.

BRIEF DESCRIPTION OF THE DRAWINGS

The invention will now be described, by way of example only, with reference to the accompanying drawings in which: —

DETAILED DESCRIPTION OF THE INVENTION

Figure 1:
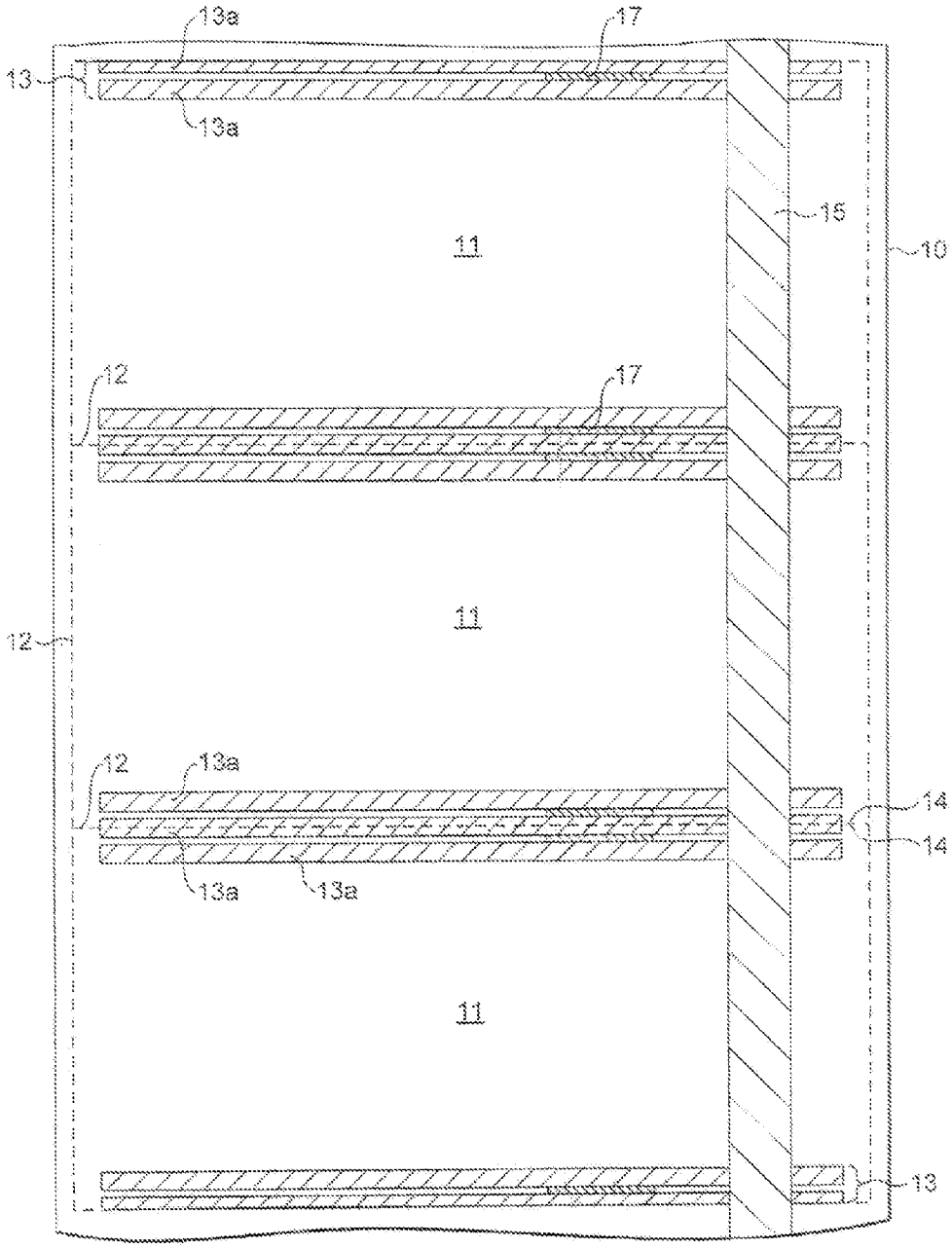
FIG. 1 is a plan view of a section of a continuous web of a fibrous substrate for making the sheets according to method of the present invention with edge reinforcing watermarks.
Figure 2A:
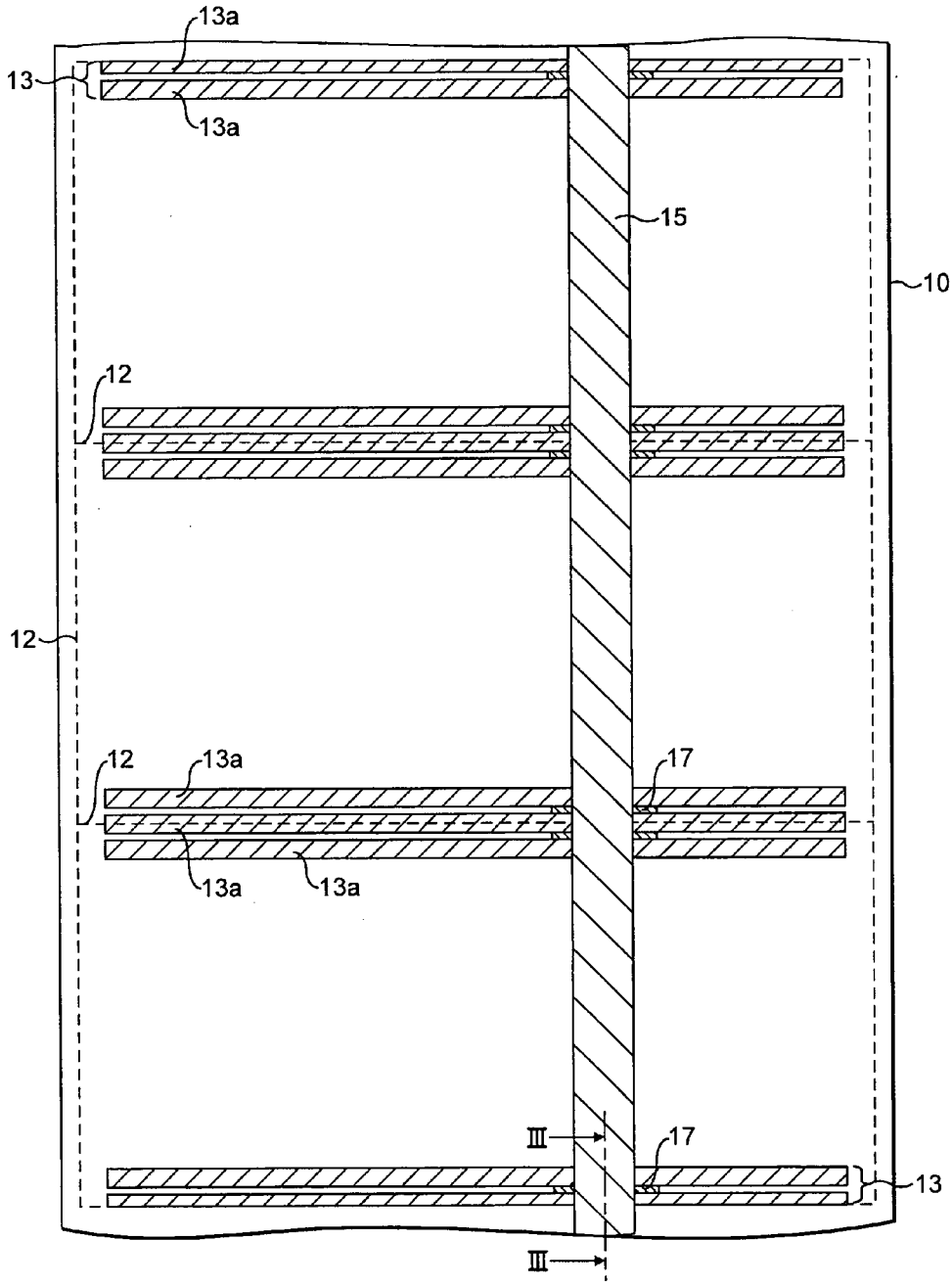
FIG. 2*a* is a plan view of the section of a web of substrate of FIG. 1 with a surface applied stripe.
Figure 2B:
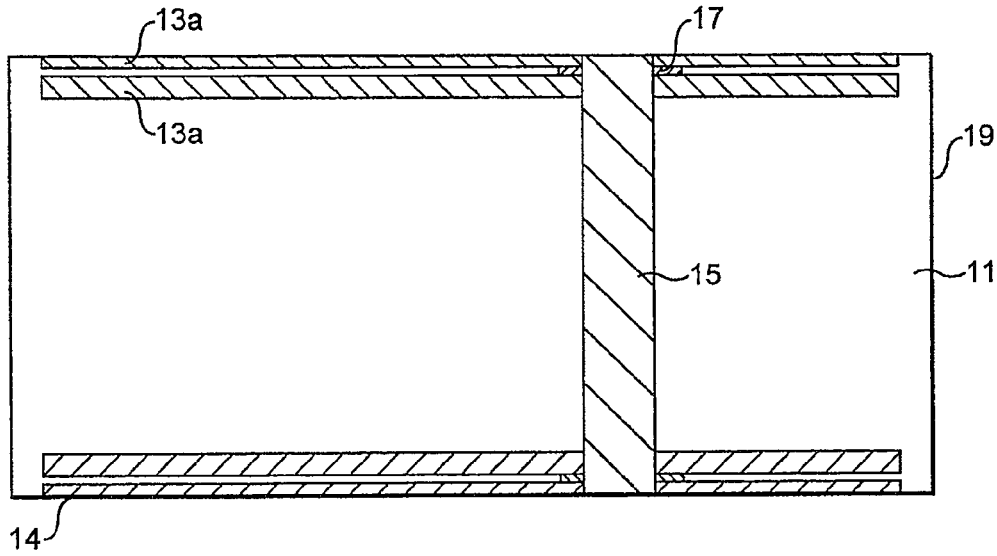
FIG. 2*b* is a plan view of a sheet of substrate cut from the web of FIG. 2*a;*

Referring to FIG. 1 there is illustrated a section of a sheet of a fibrous substrate, such as paper, in the form of a continuous web 10, which can be made by hand or using a known papermaking machine, such as a cylinder mold or Fourdrinier machine. The web 10 is subsequently cut along the marked cutting lines 12 to form individual smaller sheets 11, of which three sheets 11*a*, 11*b*, 11*c*, are shown in FIG. 1. The individual smaller sheets 11 will form security documents such as banknotes, passports identification cards and the like. A range of fiber types can be used in the making of such substrates, including synthetic or natural fibers or a mixture of both. The actual preparation of the fibers is unrestricted by the invention and will depend on what effect it is wished to produce in the finished substrate. Security paper used for security documents, such as banknotes, passports, identification cards and so on, needs to be hard wearing, resilient and self-supporting and so an appropriate fiber mix must be selected.

It should be noted that the method of the present invention may also be performed by making single sheets directly rather than making a web or a large sheet which is cut into smaller sheets.

A typical watermark is created by well-known techniques of varying the grammage of fibers, so that in some areas there is a higher grammage of fibers than the mean grammage in the base substrate layer, and in others there is a lower grammage. When viewed in transmitted light the areas of lower grammage are lighter and the areas of higher grammage are darker than the base substrate, and the contrast between the light and dark areas can be very clearly seen. It has been found that watermarks that locally increase the grammage of the paper along the edges of the document significantly reduces its propensity to tear initiation and propagation by increasing the stiffness in this area. One reason for this increase is because of the increase in the stiffness of the paper. It is well known, according to classical beam theory, that the stiffness of an object is proportional to the cube of its thickness, as described in "Pulp and Paper Technology and Treatment of Paper", 1978, page 74 by J d'A Clark, Freeman Publications Inc, San Francisco. Small increases in thickness do thus result in a significantly largely benefit in terms of stiffness. A typical stiffness measurement would be the L&W test as specified in ISO 2493.

It has been found that the stiffness of the paper increased where the watermark was a positive watermark having the effect of adding bulk to selected areas (as compared to the thickness of the base paper layer), as opposed to a negative watermark where the main portion was thinner than that of the base paper layer.

In one embodiment of the present invention, edge reinforcing watermarks 13 are formed in the web 10 such that when the web 10 is divided into smaller sheets 11, they are provided along at least one, and more preferably two opposing, edges 14 of the smaller sheets 11. In another embodiment of the invention, the edge reinforcing watermarks 13 are provided along all edges 14 of the sheet 11. The edge reinforcing watermarks 13 are preferably positive watermarks, which means that the grammage of fibers in the watermarked area is the same or greater than the mean fiber grammage of the substrate in the non-watermarked areas. The preferred form of the edge reinforcing watermarks 13 on the smaller sheets 11 is a bar 13*a* or a plurality of adjacent bars 13*a*, and the watermarks 13 preferably have elements perpendicular to the direction of the tear propagation, i.e. parallel to the edges of the sheet.

The improved resistance to tear initiation and propagation arises from the increase in the grammage of the substrate in the watermark bars 13*a* compared to the non-watermarked area, and it has been observed that the wider the bar 13*a* the greater is the observed improvement. However, it is difficult to produce positive watermark bars 13*a* of a uniform thickness along the whole length of a sheet 11 and having a width greater than 5 mm, due to washout of the fibers during the papermaking process. Therefor; a plurality of adjacent watermark bars 13*a* are preferably formed at the relevant positions in the web 10, each bar 13*a* having a preferred width in the range of 1 to 5 mm, and more preferably in the range of 2 to 4 mm.

If the paper web 10 is produced in a continuous manner on a papermaking machine, then in order to ensure that the edge reinforcing watermarks 13 comprise at least one bar 13*a* along each of the long edges of the small sheet 11, the watermark formed in the large continuously formed web 10 comprises at least two, and more preferably three or more reinforcing bars 13*a* formed on and/or adjacent the horizontal cut-line 12. Preferably the cut-line 12 runs through the center of the middle bar 13*a*. This configuration provides a tolerance for the actual position of the cut-line 12, as the cut-line 12 can be anywhere within the middle bar 13*a* or even in the spaces either side of the middle bar 13*a* to still ensure there is at least two bars 13*a* along the respective edge of each sheet 11.

It has been observed that, if a stripe 15 in the form of a polymeric film or coating is applied over the bars 13*a* of the reinforcing watermark 13, poor adhesion is observed between the substrate and the stripe 15 due to the variable profile of the substrate in the region of the reinforcing watermark 13. The reason for this poor adhesion is illustrated schematically in FIG. 3*b* which shows a cross-section of the web 10 with a stripe 15 applied over an edge reinforcing watermark 13 comprising three-bars 13*a*. It can be seen that the stripe 15 only contacts the web 10 in the raised regions of the bars 13*a* resulting in areas 16 of poor adhesion between the bars 13*a* where the stripe 15 bridges the gaps between them and has very little contact with the paper surface.

Figure 3A:
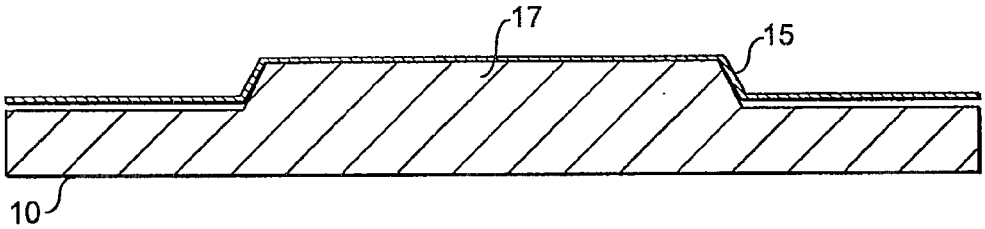
FIG. 3*a* is cross sectional end elevation on the line III-III of FIG. 2A.
Figure 3B:
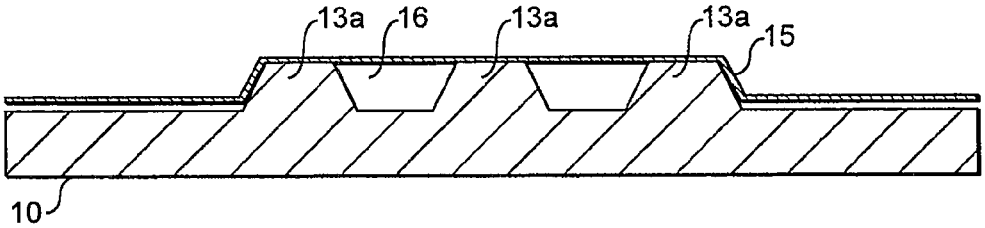
FIG. 3b PRIOR ART
FIG. 3*b* is cross sectional end elevation similar to that of FIG. 3*a* of a prior art sheet.
Figure 4:
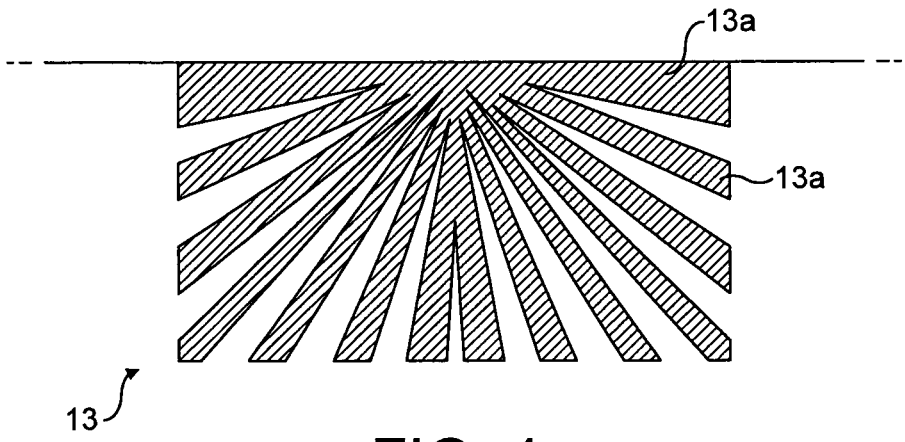
FIGS. 4 to 9 are alternative patterns for edge reinforcing watermarks for use in the present invention.
Figure 5:
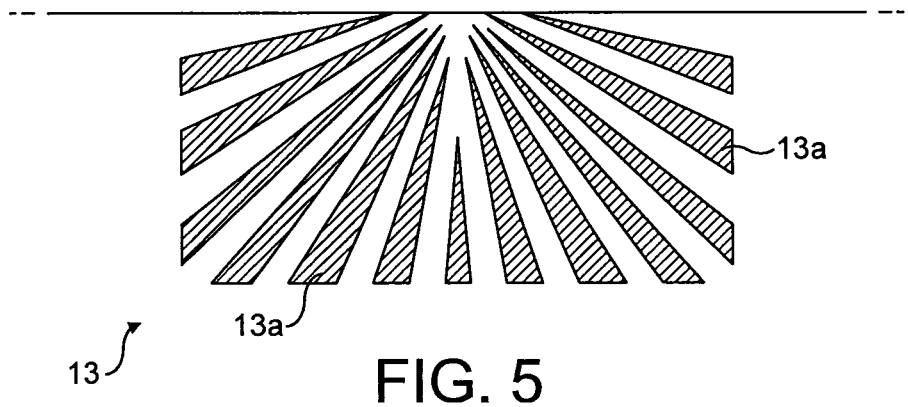
Figure 6:
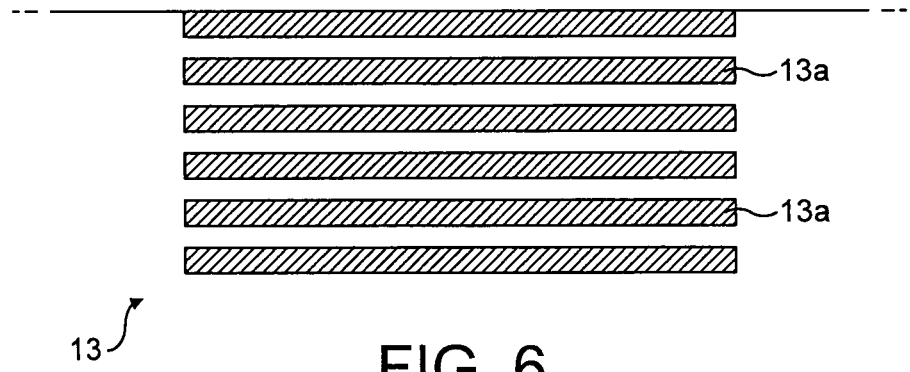
Figure 7:
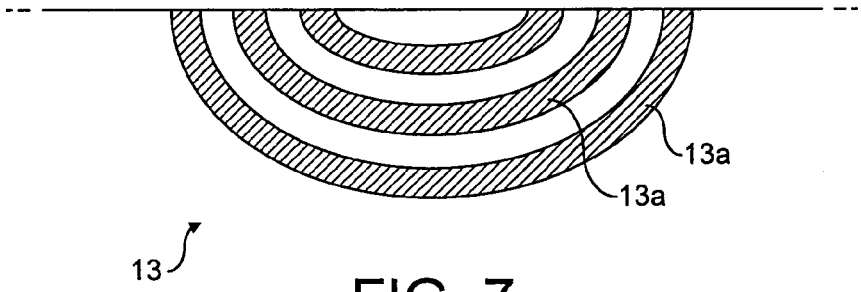
Figure 8:
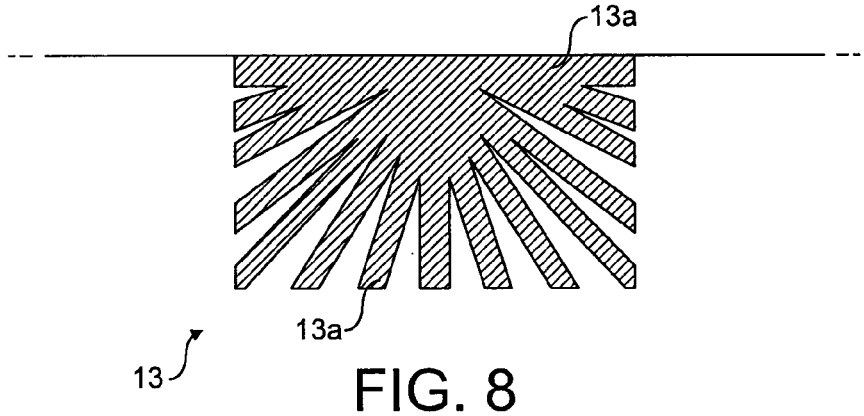
Figure 9:
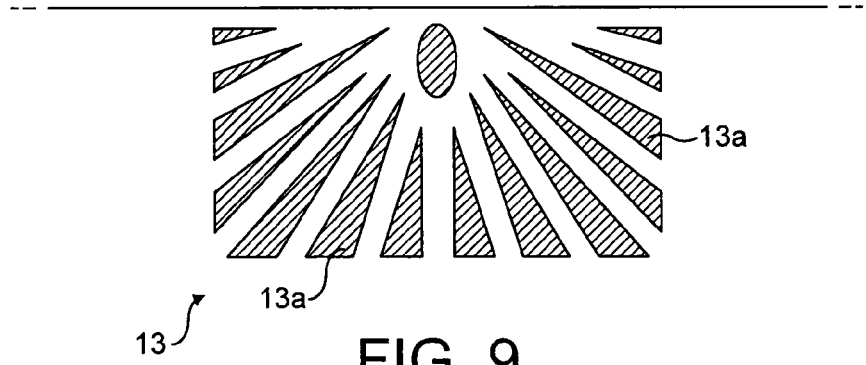

The present invention solves this problem by creating a region 17 of increased grammage of substrate which is raised and joins up the bars 13*a* in the localized region where the surface stripe 15 is to be applied. This is illustrated in FIG. 3*a*. The presence of this raised region 17 provides a smooth surface which increases the contact area between the stripe 15 and the substrate and significantly improves the adherence of the stripe 15 to the substrate.

The bars 13*a* of the reinforcing watermark 13 and the raised region 17 are preferably created by depositing fibers onto a support surface of the papermaking machine which has portions which are sunken relative to adjacent areas of the surface. In cylinder-mold papermaking, paper is formed on a partially submerged wire-cloth covered mold cylinder, which rotates in a vat containing a dilute suspension of paper fibers. As the mold cylinder rotates, water is drawn through the wire cloth depositing fibers onto the cylinder surface. In the sunken regions the fibers deposit with a greater thickness to form a positive watermark. The sunken regions are generally created by embossing the wire-cloth.

It is preferred, but not essential, that there is a gradual transition between the raised regions 17 and the adjacent regions of base substrate grammage. Experiments have shown that such a gradual transition can be achieved by having the slope between the sunken regions of the support surface and the adjacent regions at an angle which is preferably in the range of 20° to 70°, more preferably in the range of 30° to 55° and most preferably approximately 45° to the normal of the substrate forming support surface.

A wide range of designs of edge reinforcing watermarks 13 may be used in the present invention, which comprise (in some form) a plurality of stripes of increased grammage. Some suitable designs are illustrated in FIGS. 4 to 9.

Figure 10:
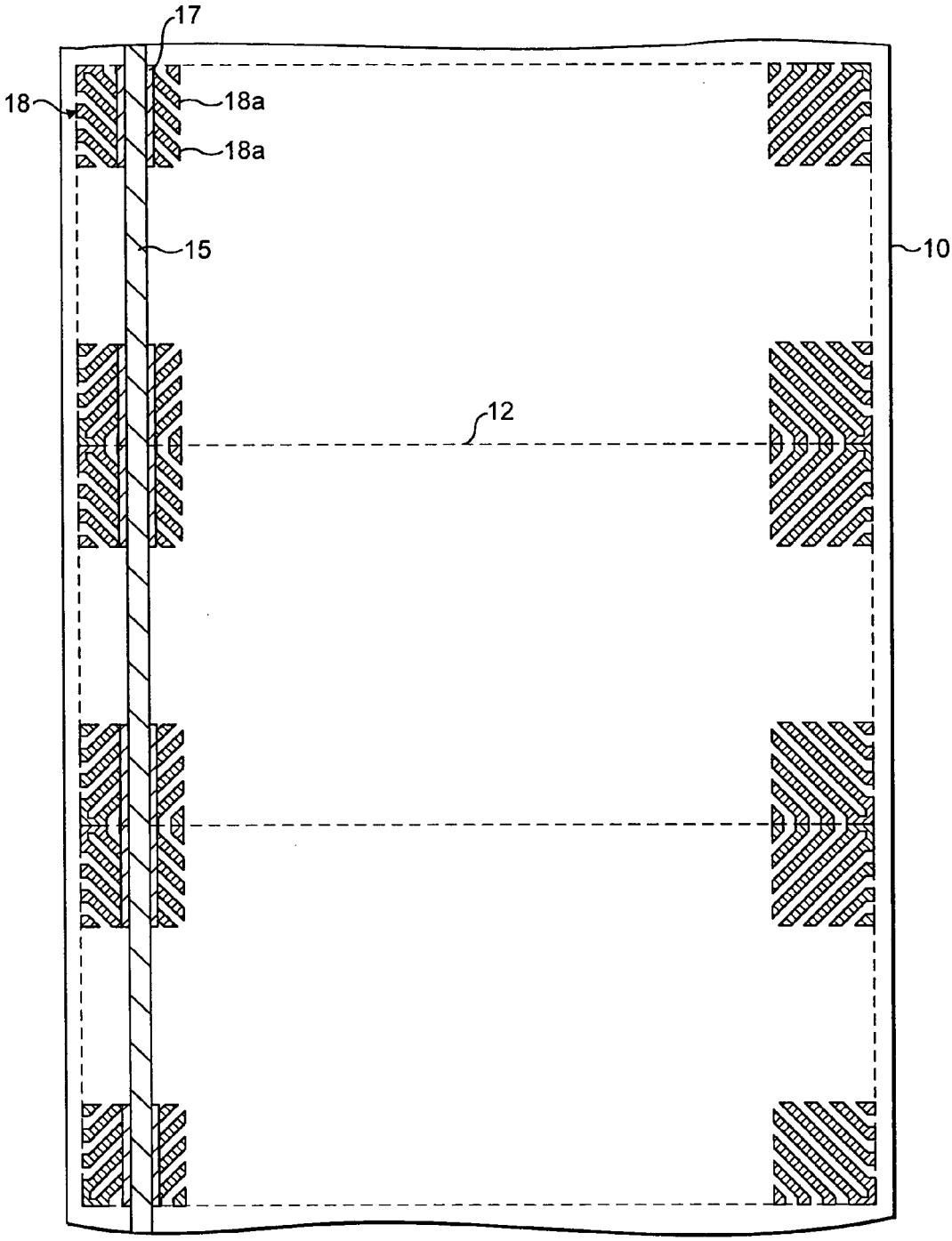
FIG. 10 is a plan view of a section of a web of substrate for making the sheets according to the method of the present invention with corner reinforcing watermarks.

The present invention is equally applicable to the manufacture of sheets having one or more corner reinforcing watermarks 18. The corner reinforcing watermarks may be located in one, two, three or all four corners and the latter is illustrated in FIG. 10. Suitable corner reinforcing watermarks 18 are as described in WO-A-03/046282. A particularly effective pattern for a corner reinforcing watermark 18 is one that results in bars 18*a* of higher grammage approaching the edges 14 of the sheet 11 at an angle between 35° and 55° to the edges 14, 19 and more preferably at 45° The preferred widths of the bars 18*a* are in the range of 1 to 2 mm wide and most preferably 1.5 mm wide.

Figure 11:
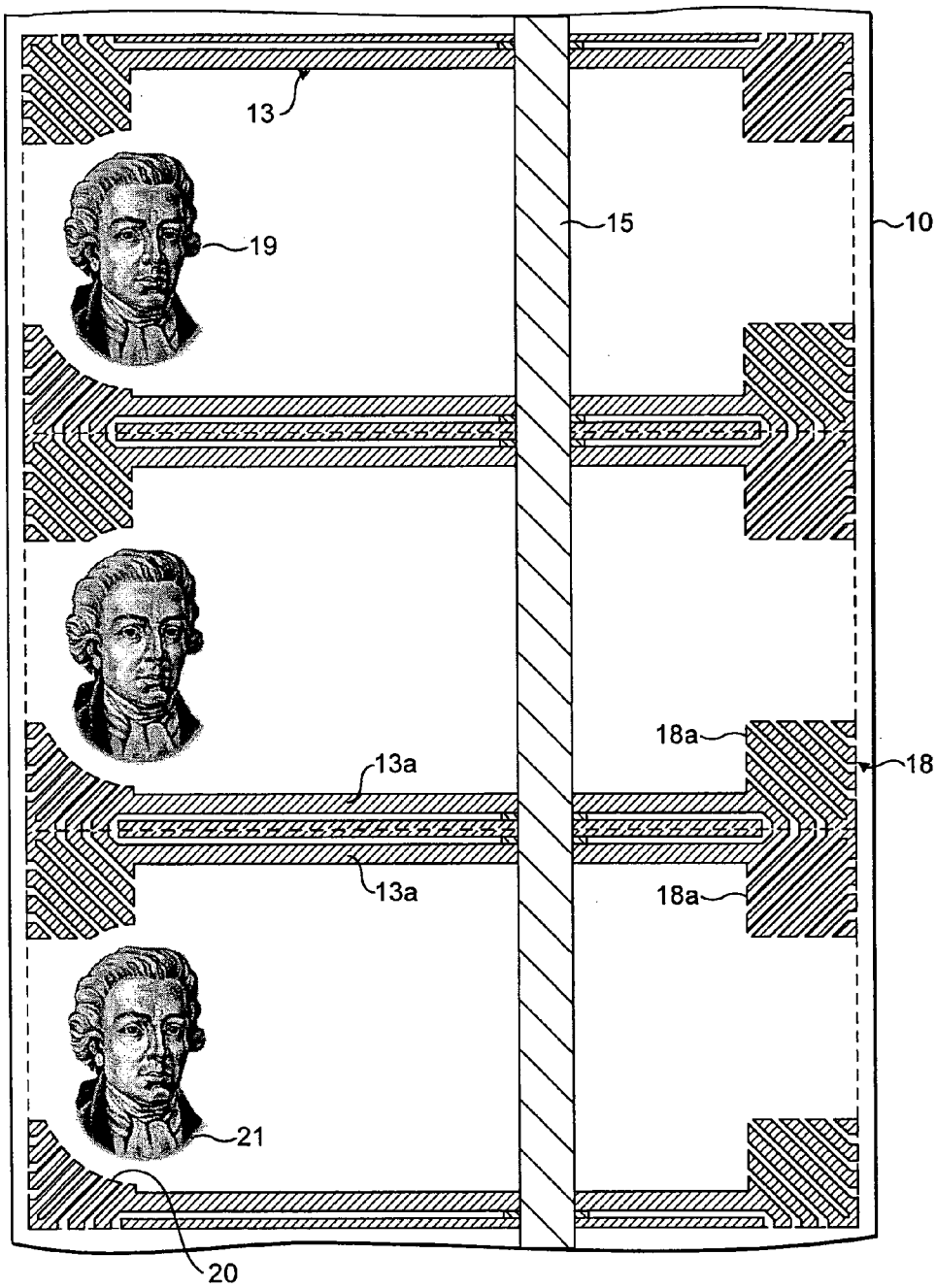
FIG. 11 is a plan view of a section of an alternative web of substrate for making the sheets of the present invention with edge and corner reinforcing watermarks.

Sheets 11 may also have both corner and center edge reinforcing watermarks 13, 18, for example, as shown in FIG. 11.

In addition, the edge and/or corner reinforcing watermarks 13,18 can be combined with a further watermark 19, such as a portrait watermark, to enhance the security and aesthetic effect of the sheet 11. As shown in FIG. 11 at least one of the corner reinforcing watermarks 18 has a shaped border (which is not necessarily a contiguous border), at least a section of which is complementary to at least a section of a border of the further watermark 19.

The aforementioned shaped section of border allows the close juxtaposition of the two watermarks 18,19 to provide an aesthetic combination and space saving. This results in an improvement in security by using close registration and cooperation of the two watermark features which makes it hard to counterfeit. The gap between the two watermarks is preferably no less than 3 mm and more preferably in the range of 3 to 5 mm.

The individual reinforcing watermarks 13,18 may be discrete or they may be joined together with watermark areas so that the watermark appears as a continuous frame around the whole sheet 11. Alternatively just some of the reinforcing watermarks 13,18 may be joined together, to provide an aesthetic pattern.

Figure 12:
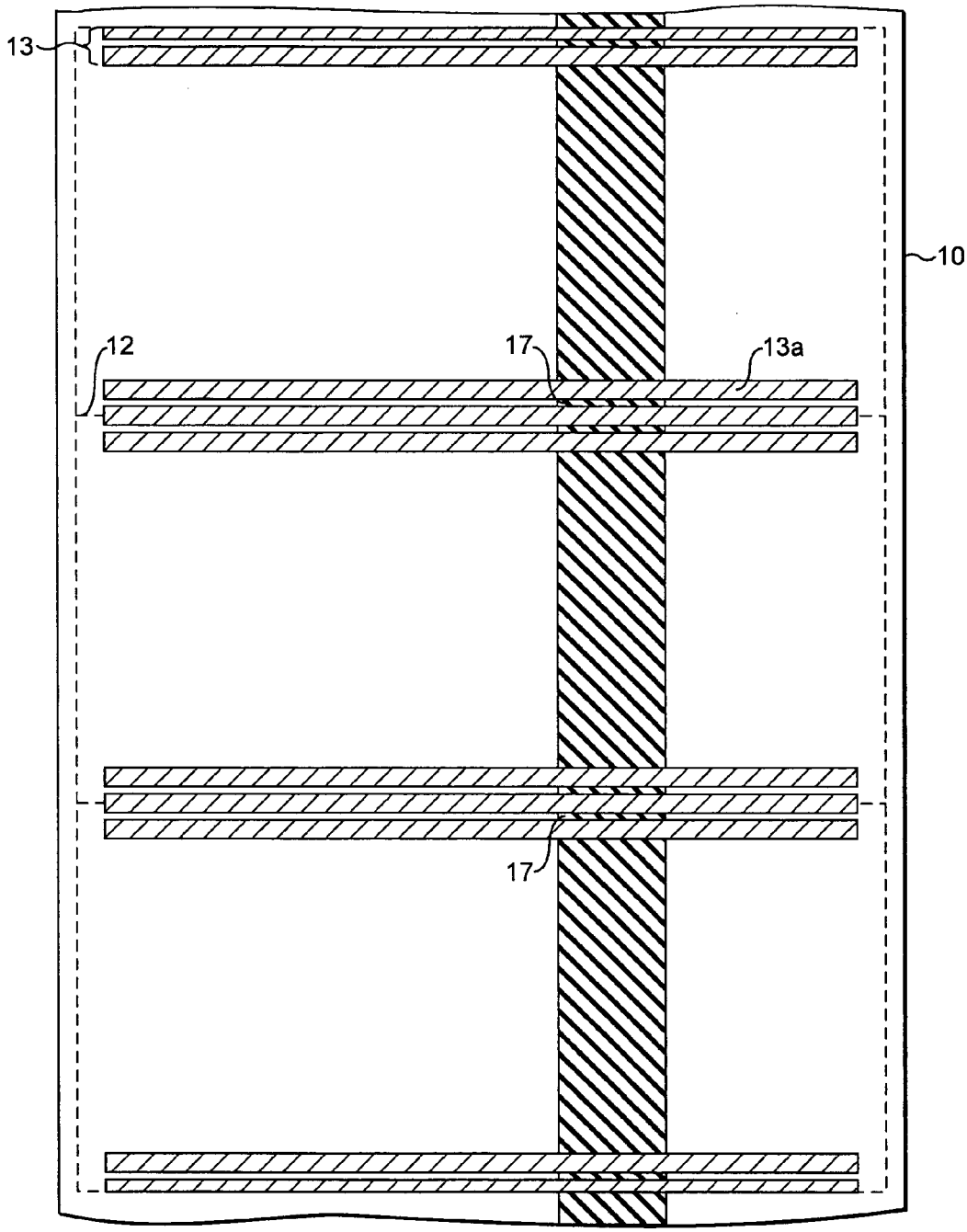
FIG. 12 is a plan view of a section of another alternative web of substrate for making the sheets of the present invention with edge reinforcing watermarks.

In a further embodiment of the present invention the smooth raised region 17 onto which the stripe 15 is applied can be extended fully across the width of the sheet 11, i.e. from long edge 14 to long edge 14, as illustrated in FIG. 12.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element thereof is entitled.

The invention claimed is:

1. A method of making a sheet from a fibrous substrate, said sheet having corners and edges joined at said corners; said method comprising the steps of:

forming the substrate by depositing fibers on a support surface;

forming at least one reinforcing watermark at a predetermined position in the substrate, which at least one reinforcing watermark increases the stiffness of the sheet in the watermarked region, said reinforcing watermark being a positive watermark formed by varying grammage of fibers of the substrate to form at least two adjacent bars of increased grammage relative to the mean grammage of fibers in adjacent areas of the substrate; and further forming at least one raised region within a localized area of the at least one reinforcing watermark, formed by increasing the grammage of fibers, which at least one raised region joins the adjacent bars within the at least one reinforcing watermark to form a localized smooth planar surface, whereas other areas of the at least one reinforcing watermark have a variable profile.

2. The method as claimed in claim 1 further comprising the step of applying a substantially planar security feature to a portion of at least one surface of the substrate across the smooth planar surface.

3. The method as claimed in claim 1 in which the substrate is first formed as a web which is subsequently cut into a plurality of sheets.

4. The method as claimed in claim 1 in which the substrate forms a single sheet.

5. The method as claimed in claim 1 in which reinforcing watermarks are formed in at least one corner of the sheet so as to increase the stiffness of the sheet in said corners.

6. The method as claimed in claim 5 in which the corner reinforcing watermark comprises a plurality of bars substantially extending at an angle of 45° to the edges of the sheet.

7. The method as claimed in claim 6 in which the width of the bars is 1.5 mm.

8. The method as claimed in claim 5 in which the corner reinforcing watermark comprises a plurality of bars having a width in the range of 1 to 2 mm.

9. The method as claimed in claim 1 in which the reinforcing watermark is formed along at least one edge of the sheet so as to increase the stiffness of the sheet along said at least one edge.

10. The method as claimed in claim 9 in which the reinforcing watermark comprises at least one bar formed substantially parallel to the edge of the sheet.

11. The method as claimed in claim 9 in which the reinforcing watermark comprises at least one bar having a width in the range of 1 to 5 mm.

12. The method as claimed in claim 11 in which the width of the at least one bar lies in the range of 2 mm to 4 mm.

13. The method as claimed in claim 1 in which the sheet has corner and edge reinforcing watermarks.

14. The method as claimed in claim 1 in which the bars of the reinforcing watermark(s) are straight.

15. The method as claimed in claim 1 in which a plurality of reinforcing watermarks are joined by watermark patterns.

16. The method as claimed in claim 1 in which at least one of which reinforcing watermarks has a border, at least a section of said border having a complementary shape with respect to and is located in close registration with at least a section of a border of a further watermark.

17. The method as claimed in claim 1 in which the at least one raised region is formed with sides which are at an angle lying in the range of 20° to 70° to the normal of the adjacent sheet surface.

18. The method as claimed in claim 1 in which the at least one raised region is formed with sides which are at an angle lying in the range of 30° to 55° to the normal of the adjacent sheet surface.

19. The method as claimed in claim 1 in which the at least one raised region is formed with sides which are at an angle of substantially 45° to the normal of the adjacent sheet surface.

20. The method as claimed in claim 1 in which the raised region extends across the width of the sheet.

21. The sheet formed from a fibrous substrate according to claim 1.

22. A security document made from a sheet according to claim 21.

23. The security document according to claim 21 comprising any one of a banknote, fiscal check, travelers check, fiscal stamp, postal stamp, certificate of authenticity, brand protection article, bond, certificate and voucher.

* * * * *